US012352517B2

(12) United States Patent
Gibbens et al.

(10) Patent No.: US 12,352,517 B2
(45) Date of Patent: Jul. 8, 2025

(54) DETENT DELAYED BLOWBACK SYSTEM AND METHODS

(71) Applicant: Peppermill Design, LLC, Show Low, AZ (US)

(72) Inventors: Kevin W Gibbens, Show Low, AZ (US); David W. Gibbens, Show Low, AZ (US)

(73) Assignee: Peppermill Design, LLC, Show Low, AZ (US)

( * ) Notice: Subject to any disclaimer, the term of this patent is extended or adjusted under 35 U.S.C. 154(b) by 64 days.

(21) Appl. No.: 18/498,593

(22) Filed: Oct. 31, 2023

(65) Prior Publication Data

US 2024/0142185 A1 May 2, 2024

Related U.S. Application Data

(60) Provisional application No. 63/381,724, filed on Oct. 31, 2022.

(51) Int. Cl.

| | |
|---|---|
| ***F41A 3/46*** | (2006.01) |
| ***F41A 3/26*** | (2006.01) |
| ***F41A 3/86*** | (2006.01) |

(52) U.S. Cl.

CPC ..... *F41A 3/86* (2013.01); *F41A 3/26* (2013.01); *F41A 3/46* (2013.01)

(58) Field of Classification Search

CPC ..... F41A 3/86; F41A 3/26; F41A 3/54; F41A 3/44; F41A 3/46

USPC ..... 89/194, 182, 183

See application file for complete search history.

(56) References Cited

U.S. PATENT DOCUMENTS

2005/0257682 A1* 11/2005 Hajjar ..... F41A 3/46 89/188

2010/0186581 A1* 7/2010 Hajjar ..... F41A 3/46 89/188

* cited by examiner

*Primary Examiner* — Jonathan C Weber

(74) *Attorney, Agent, or Firm* — Schmeiser, Olsen & Watts LLP; Sean K. Enos

(57) ABSTRACT

A delayed blowback system for a firearm is provided. The system includes a bolt with two detent members operatively coupled within the bolt, each detent member comprising a detent. The system further includes a recoil spring guide rod having two matching recesses on opposing sides of the recoil spring guide rod, wherein the bolt and the two detent members are coupled to and slidable along the recoil spring guide rod between a firing position and a recoil position. The firing position includes the detents resting in the matching recesses on the recoil spring guide rod in response to a round being fired, the bolt moves back and pushes the detent members back, wherein by nature of a geometry of the detents and the matched recesses, the detent members outward in opposite directions and perpendicular sliding along the recoil spring guide rail in the recoil position to complete a recoil cycle.

6 Claims, 21 Drawing Sheets

DETENT DELAYED BLOWBACK SYSTEM AND METHODS

CROSS REFERENCE TO RELATED APPLICATION[S]

This application claims priority to U.S. Provisional Patent Application Ser. No. 62/381,724, filed Oct. 31, 2022, the disclosure of which is hereby incorporated entirely herein by reference.

BACKGROUND OF THE INVENTION

Technical Field

This invention relates generally to a blowback system for a firearm, and more particularly to a delayed blowback system and methods.

State of the Art

Conventional blowback designs and embodiments for firearms rely on the mass of the bolt (or rather its momentum/lack of movement) being sufficient to hold the cartridge case in the chamber long enough for the bullet to exit the barrel and the pressure to be reduced so that the cartridge case can exit the chamber without it causing a rupture of the case. This prevents injury to the operator and anyone nearby. The drawback of these conventional blowback systems is the weight and there are not conventional means available that can address the weight factor of conventional blowback designs and embodiments.

Accordingly, there is a need for a new and improved delayed blowback system and methods that provide the benefits of the conventional blowback system designs while still saving on weight of the bolt.

SUMMARY OF THE INVENTION

An embodiment of the present invention includes a delayed blowback system for a firearm, the system comprising: a bolt with a bolt face and two detent members operatively coupled within the bolt, each detent member comprising a detent; and a recoil spring guide rod comprising two matching recesses on opposing sides of the recoil spring guide rod, wherein the bolt and the two detent members are coupled to and slidable along the recoil spring guide rod between a firing position and a recoil position, wherein: the firing position comprises the detents of the detent members resting in the matching recesses on the recoil spring guide rod and in position for firing a round; movement from the firing position to the recoil position comprises, in response to the round being fired, a cartridge case of the round applies an initial force on the bolt face of the bolt in a direction opposite a barrel of the firearm, and wherein a geometry of the detents of the detent members and a geometry of the matched recesses in the recoil spring guide rod operate to force the detent members in opposite directions and perpendicular to the direction of the initial force; and moving the bolt along the recoil guide rod in the direction of the initial force to perform a recoil cycle and moving the bolt back to the firing position.

Another embodiment includes a method of delaying blowback of a bolt of a firearm, the method comprising: in response to firing a round from a firearm, applying an initial force to a bolt of the firearm in a direction opposite of a barrel of the firearm, wherein detents of detent members coupled within the bolt rest within matching recesses in a recoil spring guide rod prior to firing the round; delaying recoil of the bolt along a recoil spring guide rod, wherein delaying the recoil comprises moving the detents and detent members in opposite directions and perpendicular to the direction of the initial force exerted on the bolt in response to a geometry of the detents of the detent members and a geometry of the matched recesses in the recoil spring guide rod operating to force the detents and detent members in opposite directions and perpendicular to the direction of the initial force exerted on the bolt; after delaying recoil of the bolt, moving the bolt along the recoil spring guide rod in the direction of the initial force to perform a recoil cycle; and moving back to the firing position.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

As discussed above, embodiments of the present invention relate to delayed blowback system for a firearm.

Figure 1:
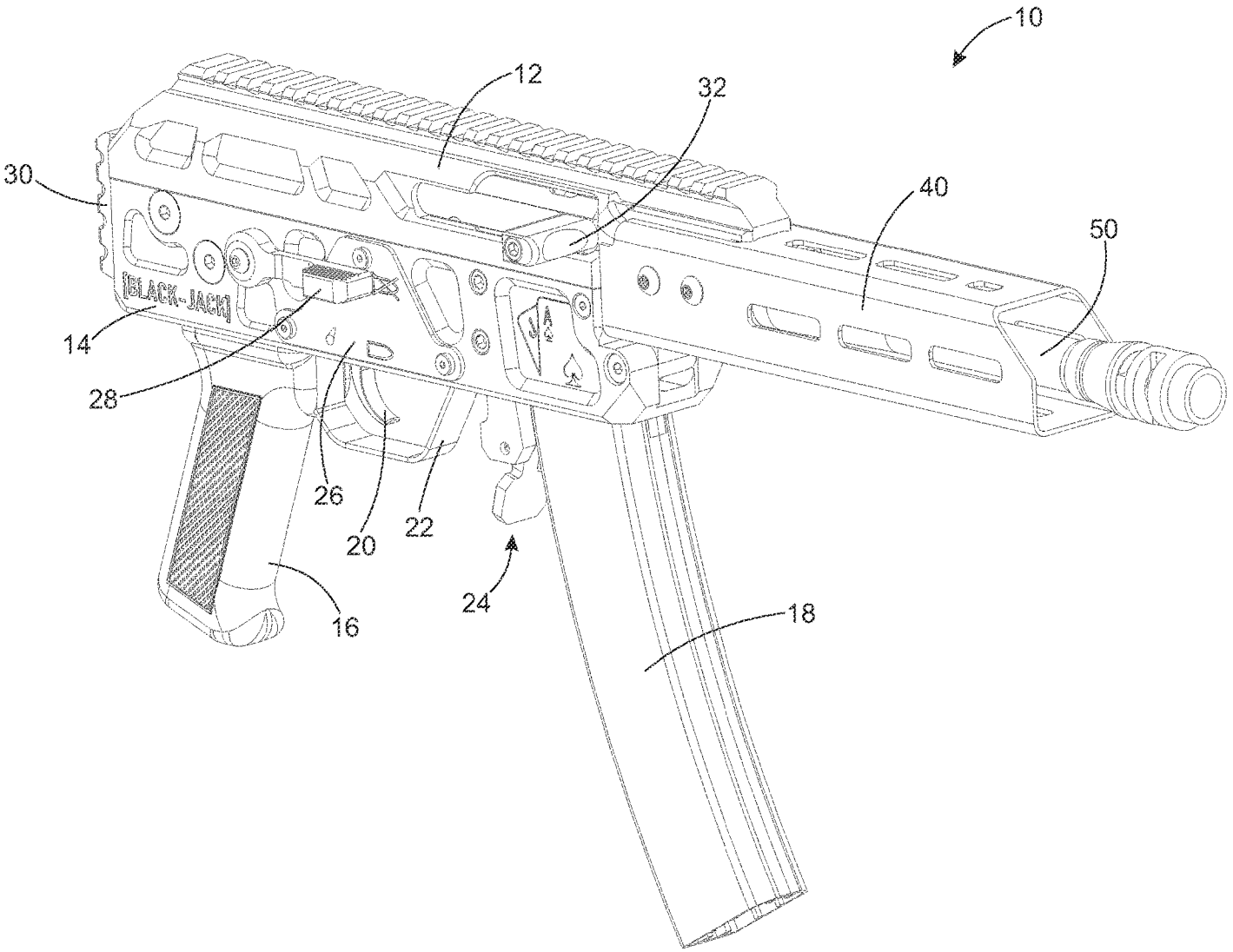
FIG. 1 is a perspective view of a firearm with a delayed blowback system according to an embodiment.
Figure 2:
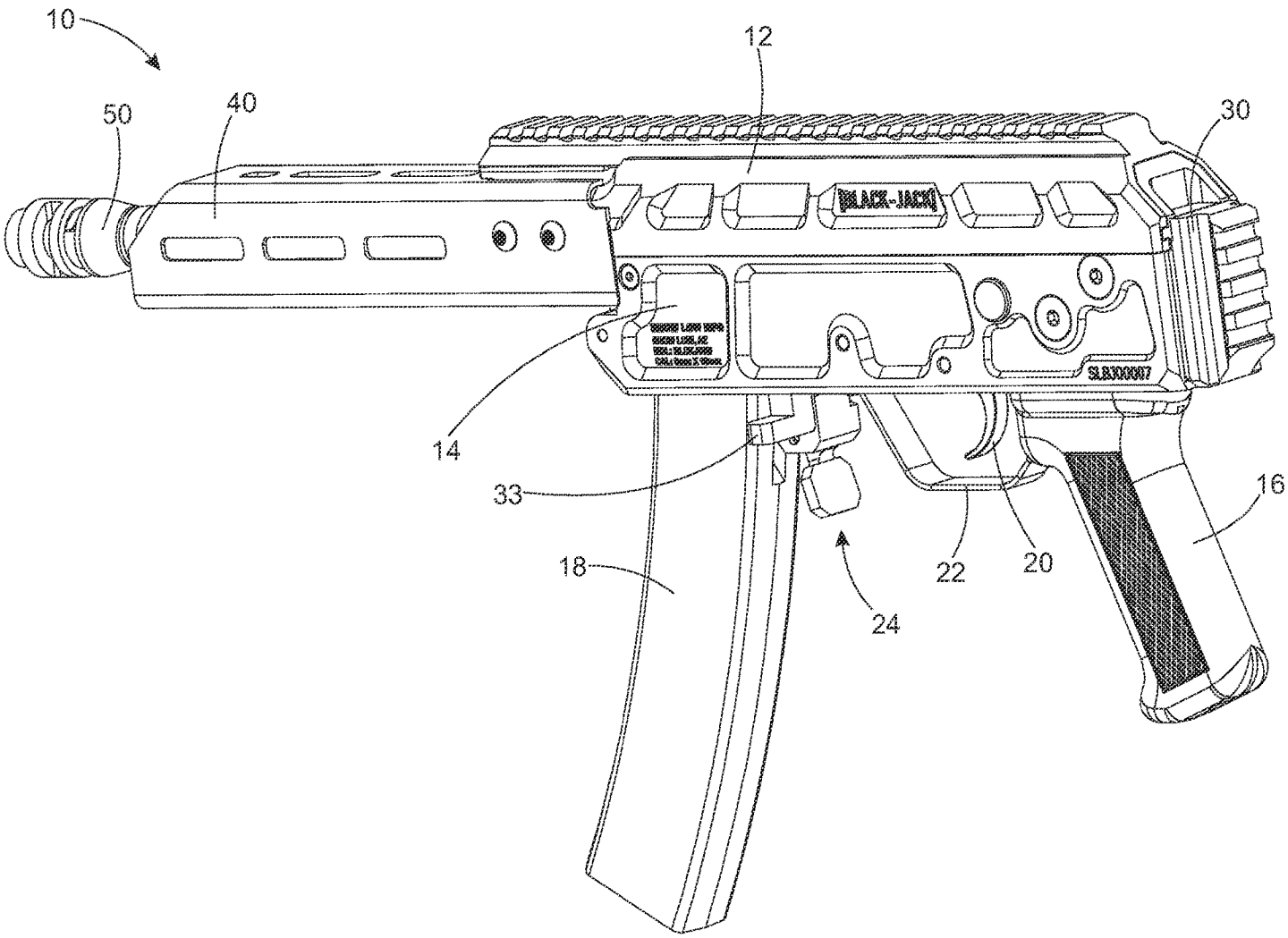
FIG. 2 is a perspective view of a firearm with a delayed blowback system according to an embodiment.
Figure 3:
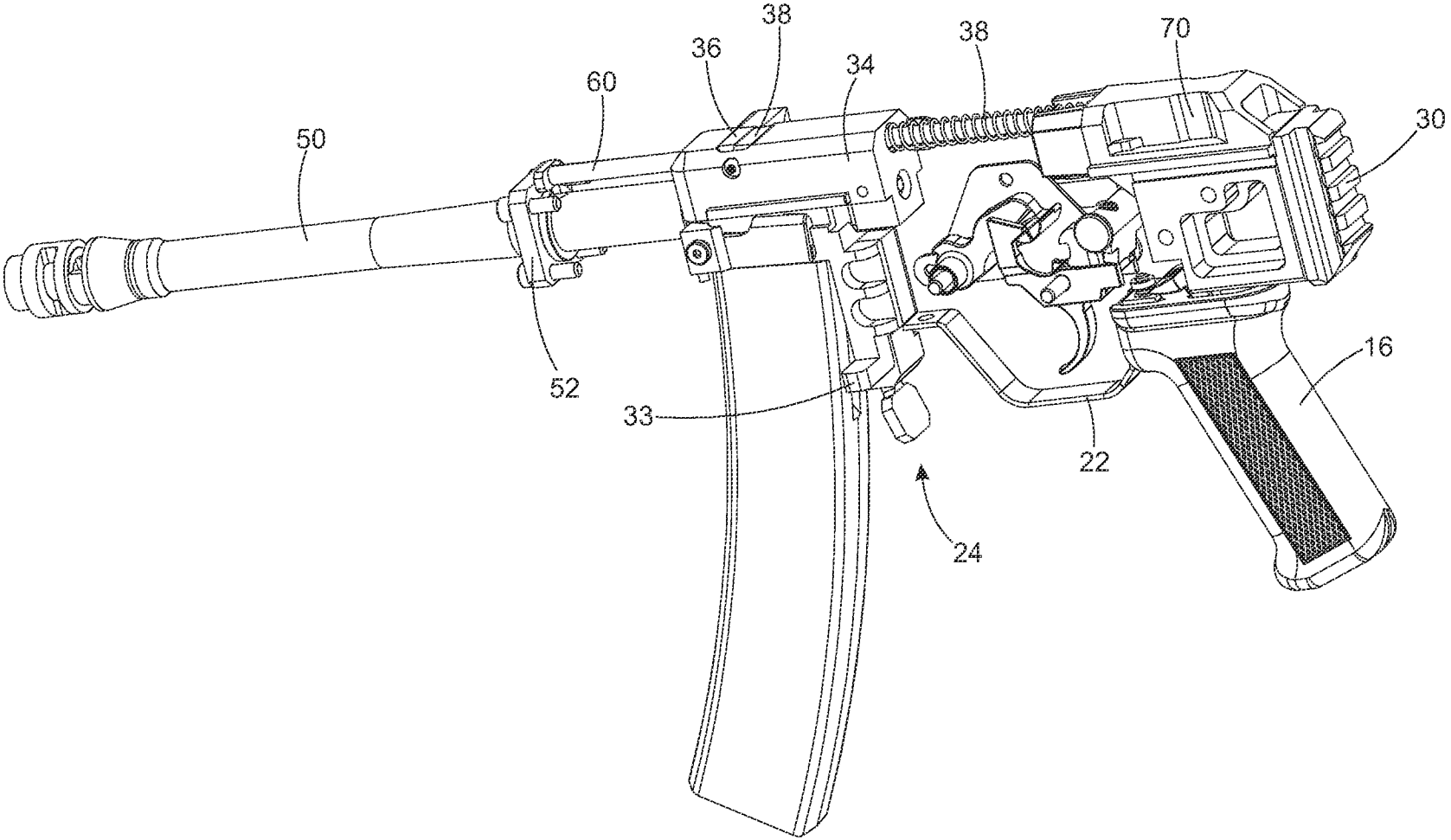
FIG. 3 is a perspective partial view of a firearm with a delayed blowback system according to an embodiment.
Figure 4:
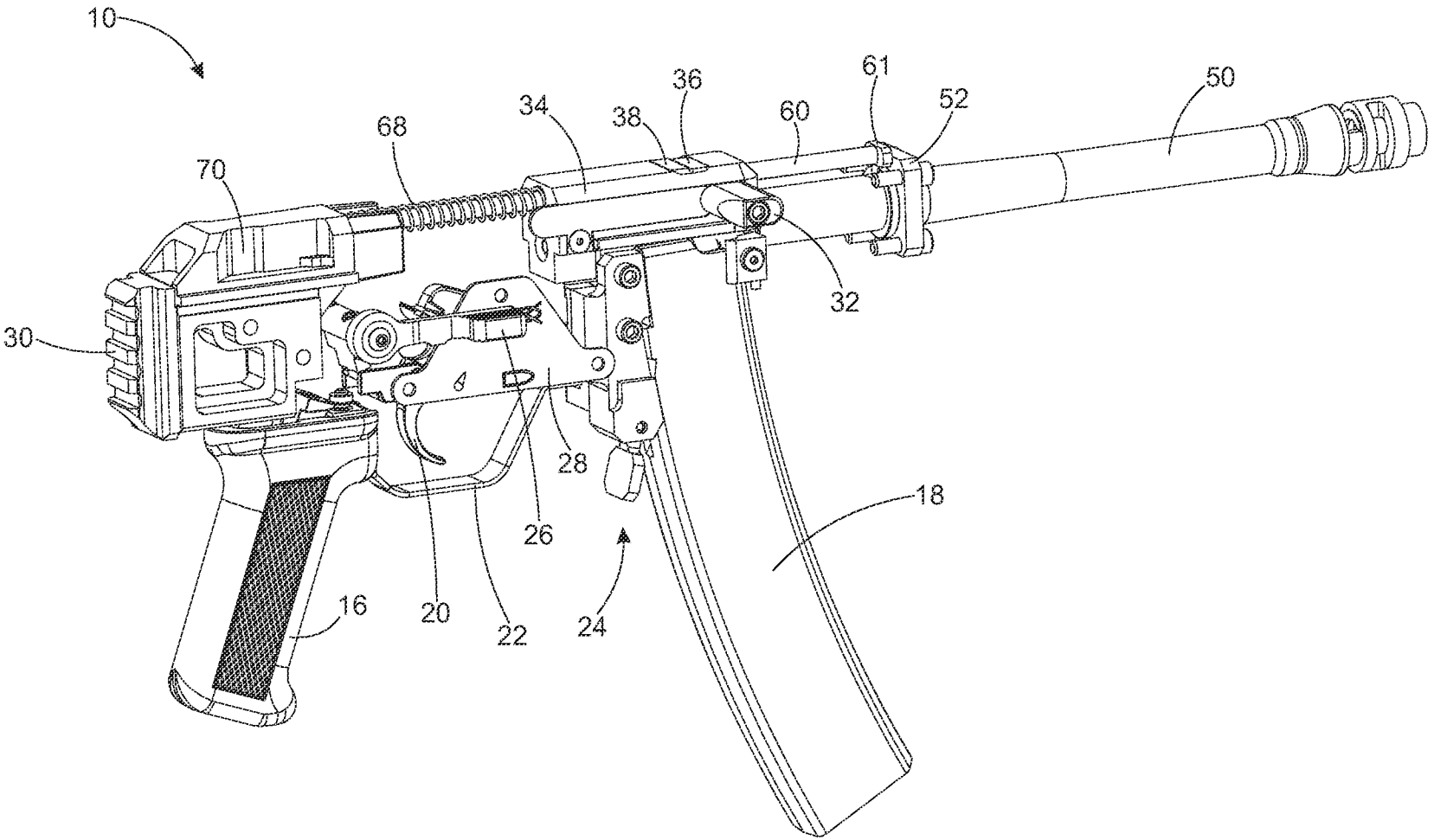
FIG. 4 is a perspective partial view of a firearm with a delayed blowback system according to an embodiment.
Figure 5:
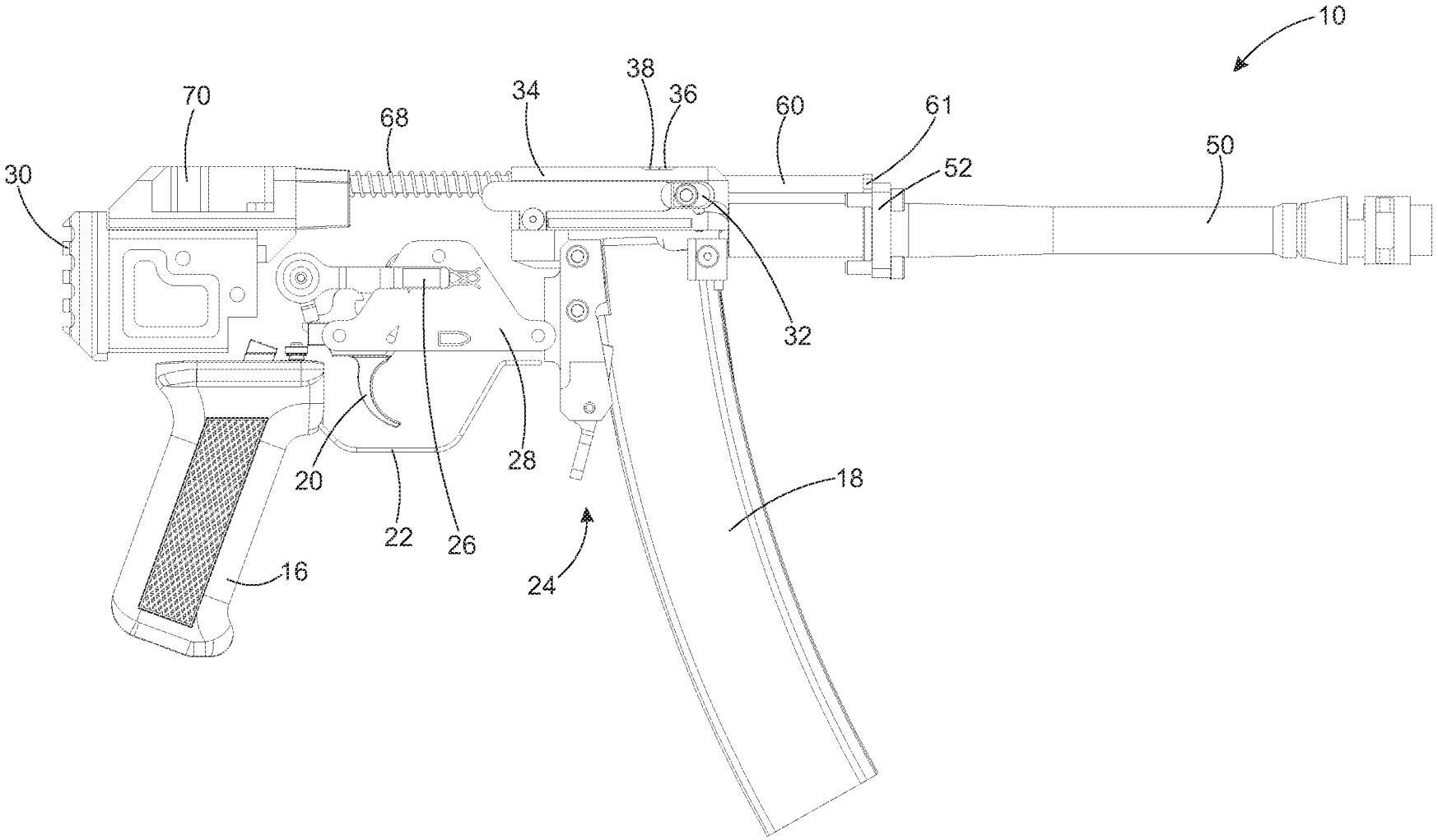
FIG. 5 is a side partial view of a firearm with a delayed blowback system according to an embodiment.
Figure 6:
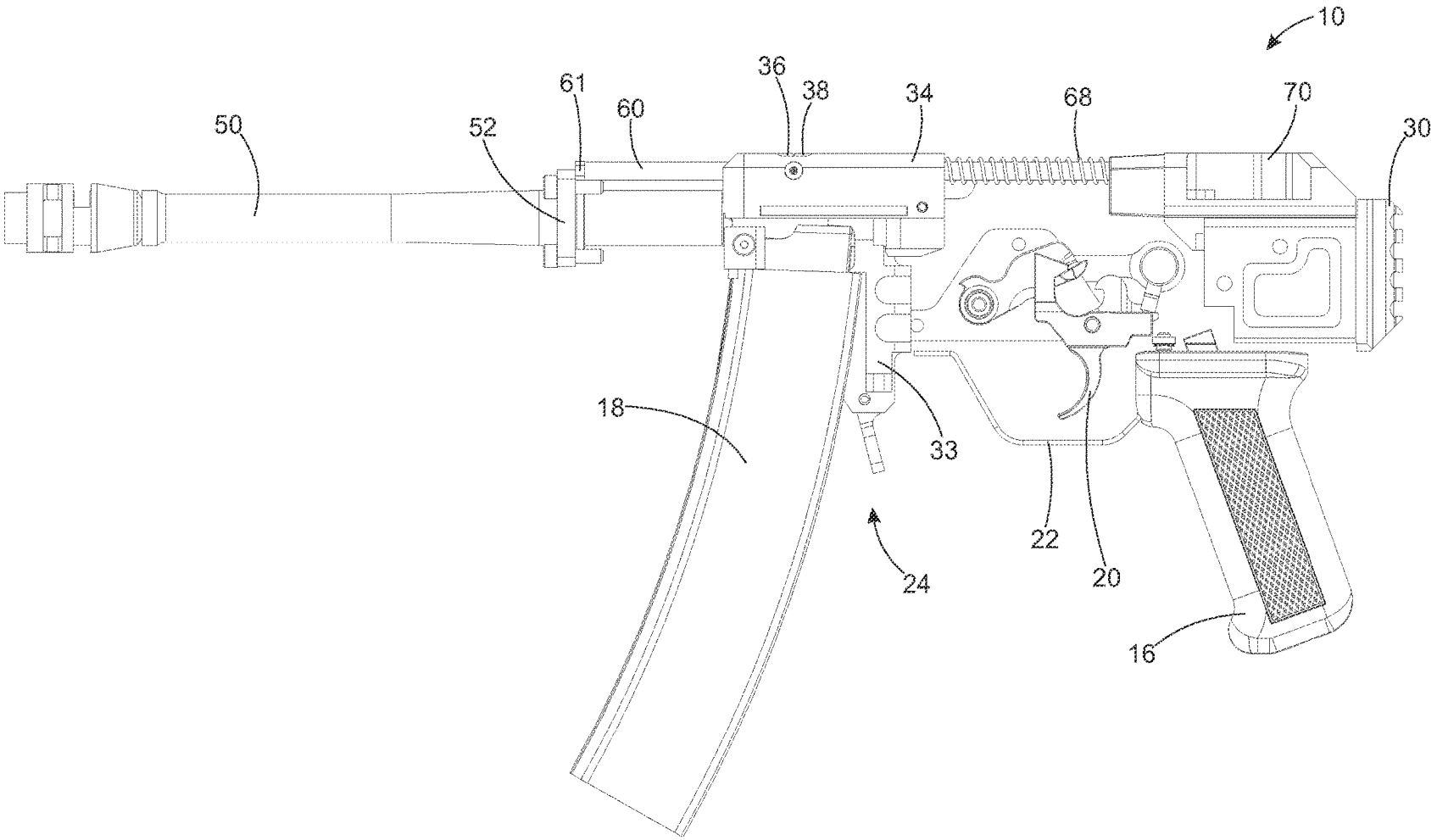
FIG. 6 is a side partial view of a firearm with a delayed blowback system according to an embodiment.
Figure 7:
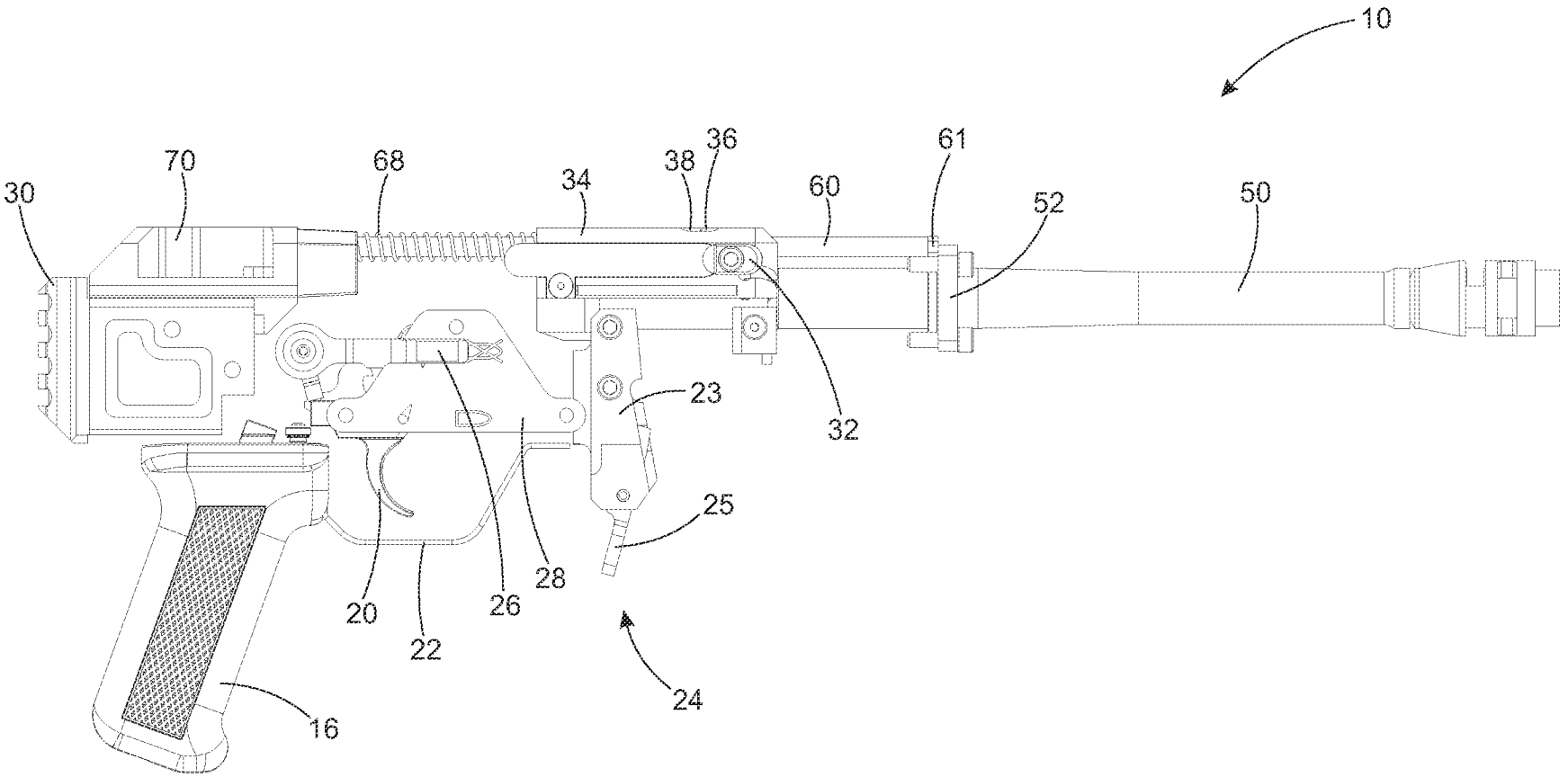
FIG. 7 is a side partial view of a firearm with a delayed blowback system according to an embodiment.
Figure 8:
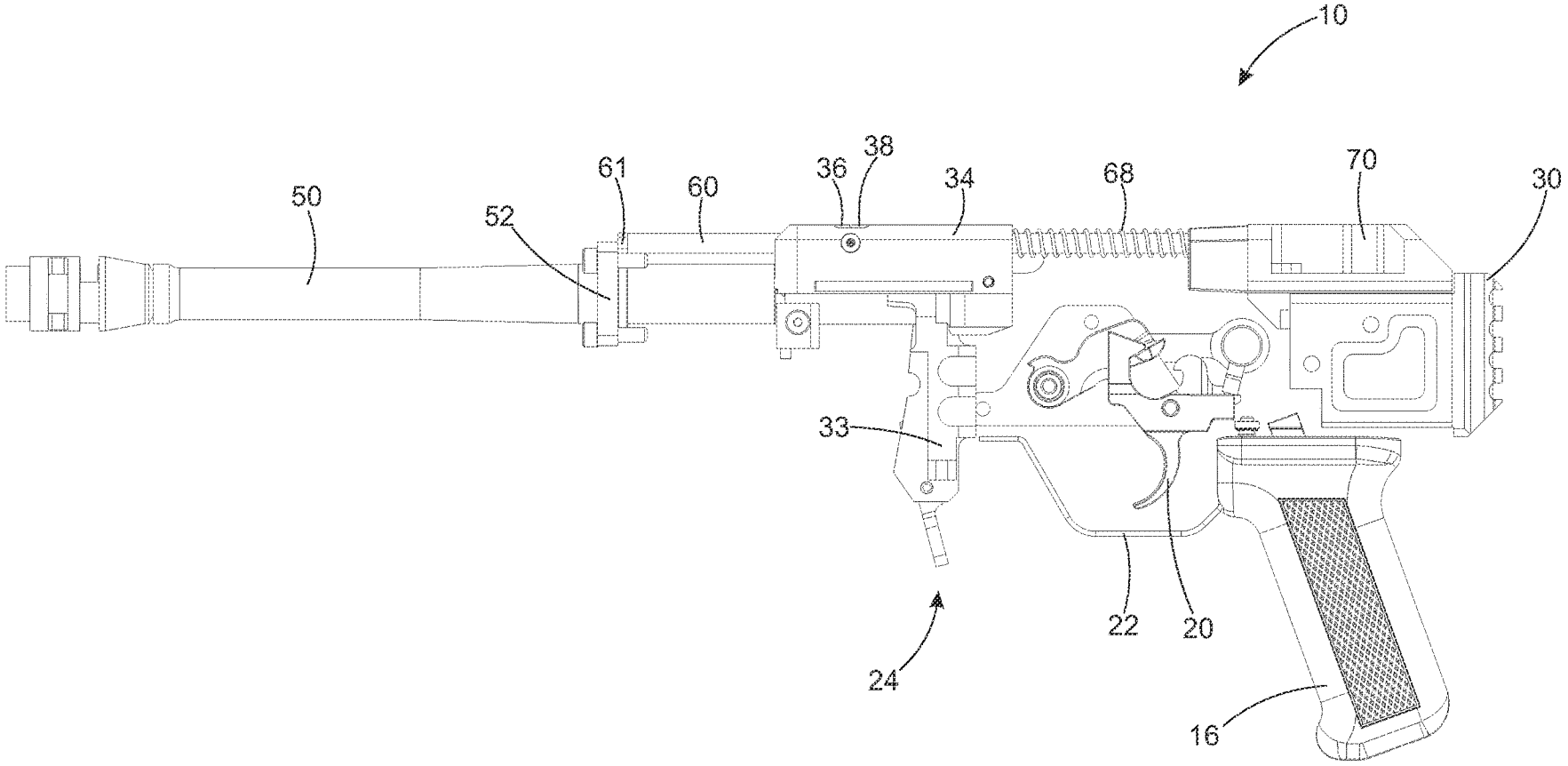
FIG. 8 is a side partial view of a firearm with a delayed blowback system according to an embodiment.
Figure 9:
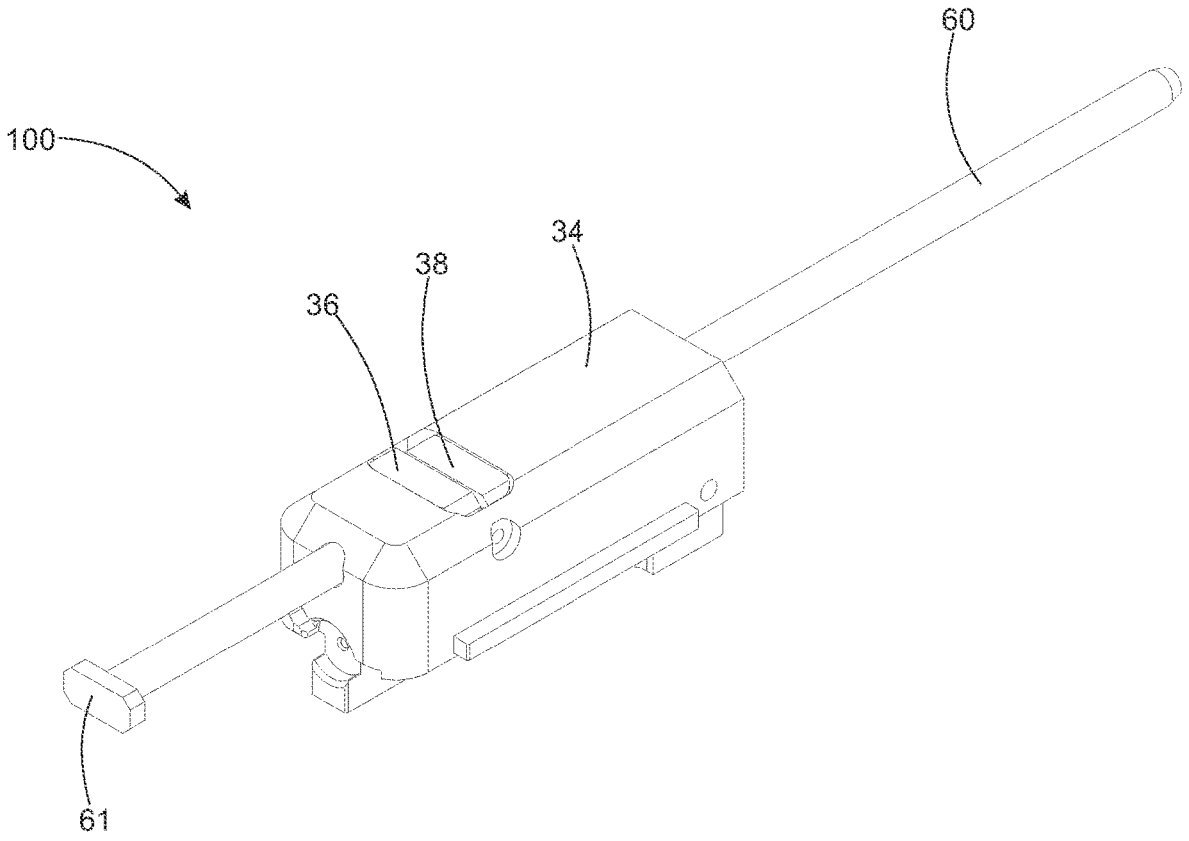
FIG. 9 is a perspective view of a bolt and recoil spring guide rod of a delayed blowback system according to an embodiment.
Figure 10:
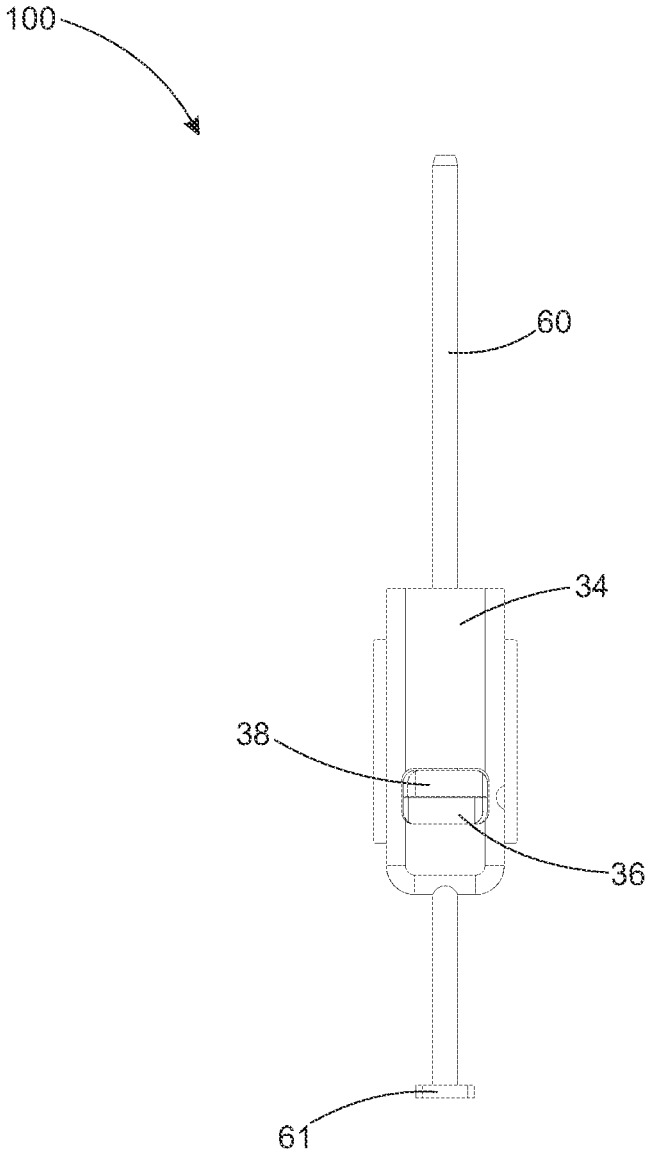
FIG. 10 is a top view of a bolt and recoil spring guide rod of a delayed blowback system according to an embodiment.
Figure 11:
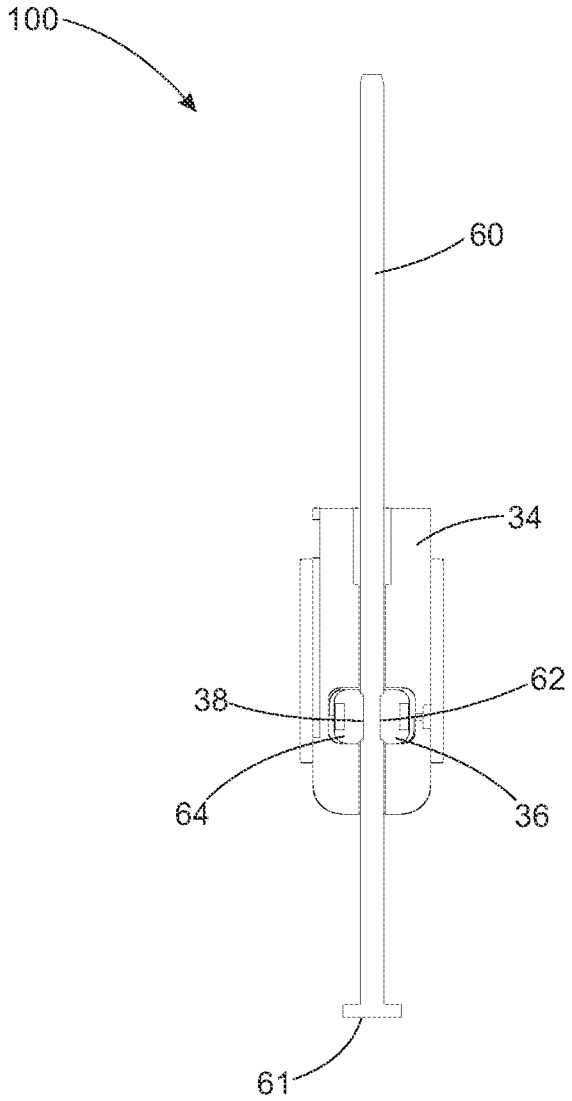
FIG. 11 is a section view of a bolt and recoil spring guide rod of a delayed blowback system according to an embodiment.
Figure 12:
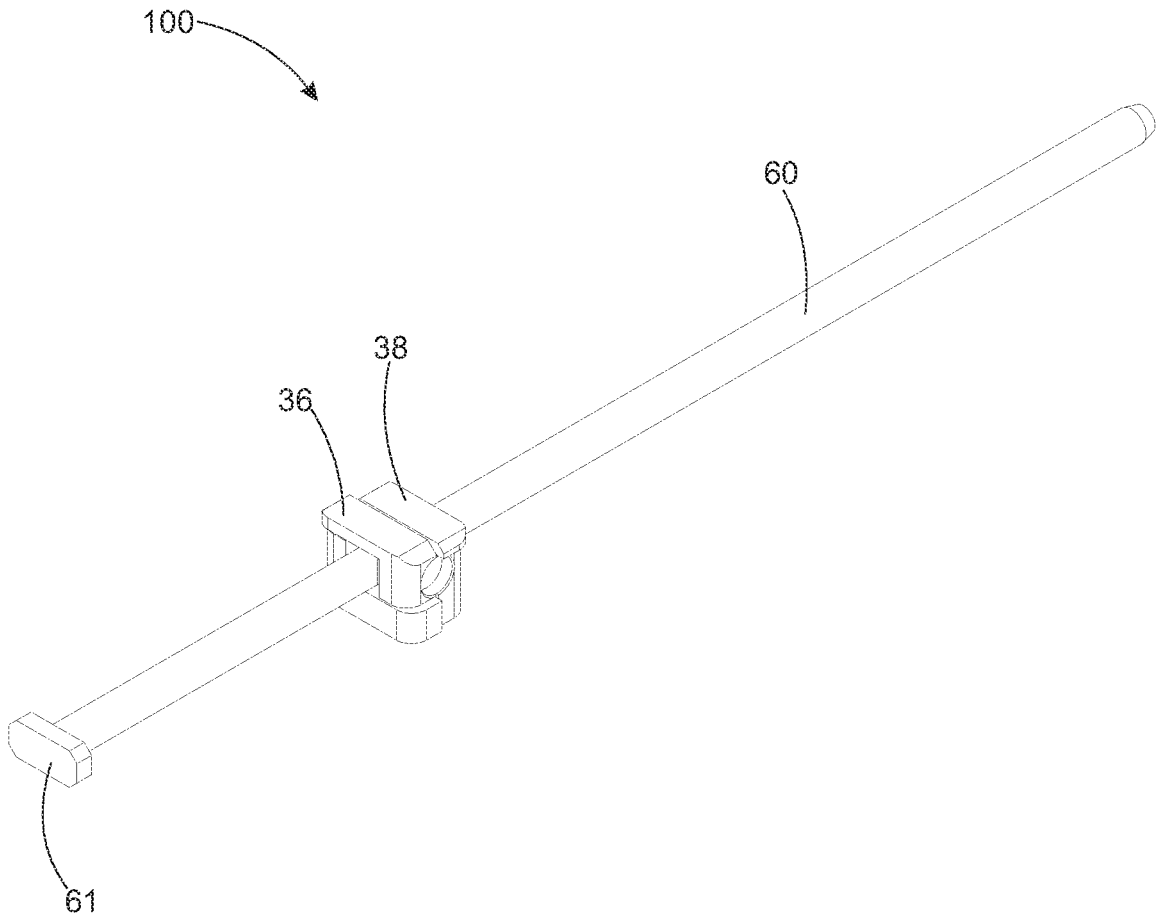
FIG. 12 is a perspective view of detent members coupled to a recoil spring guide rod of a delayed blowback system according to an embodiment.
Figure 13A:
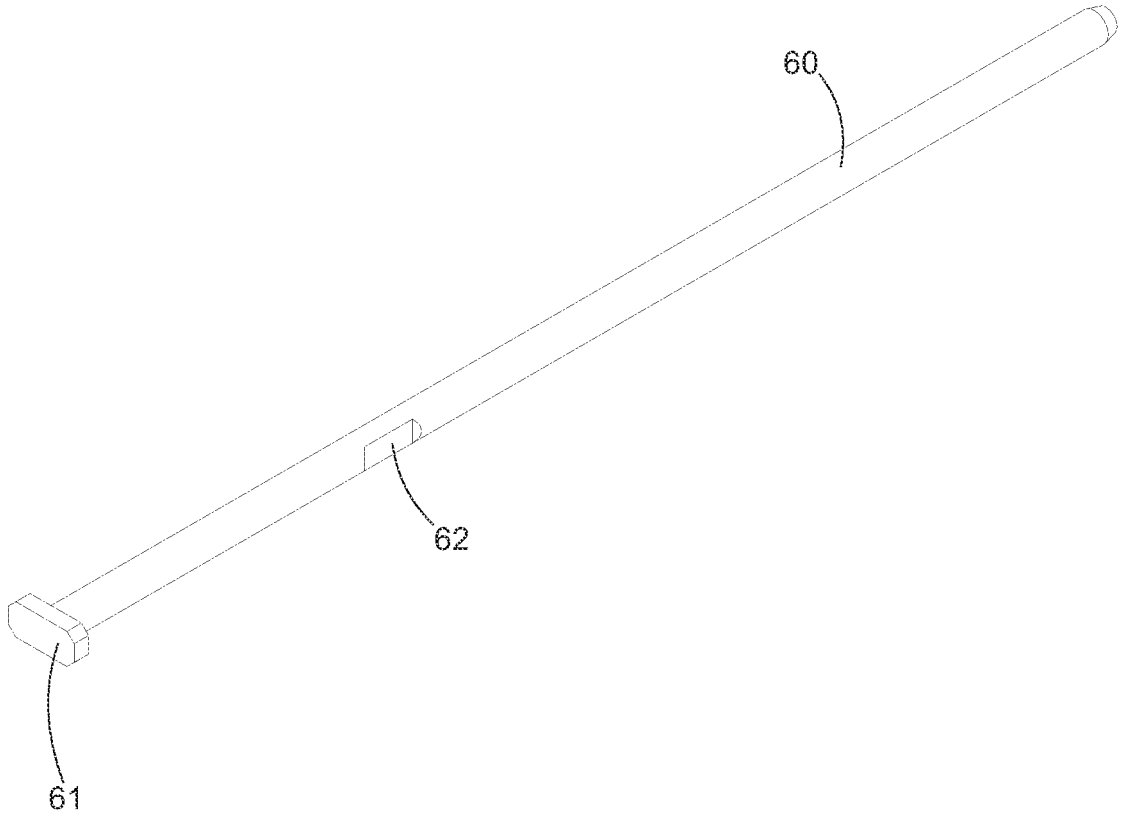
FIG. 13A is a perspective view of a recoil spring guide rod of a delayed blowback system according to an embodiment.
Figure 13B:
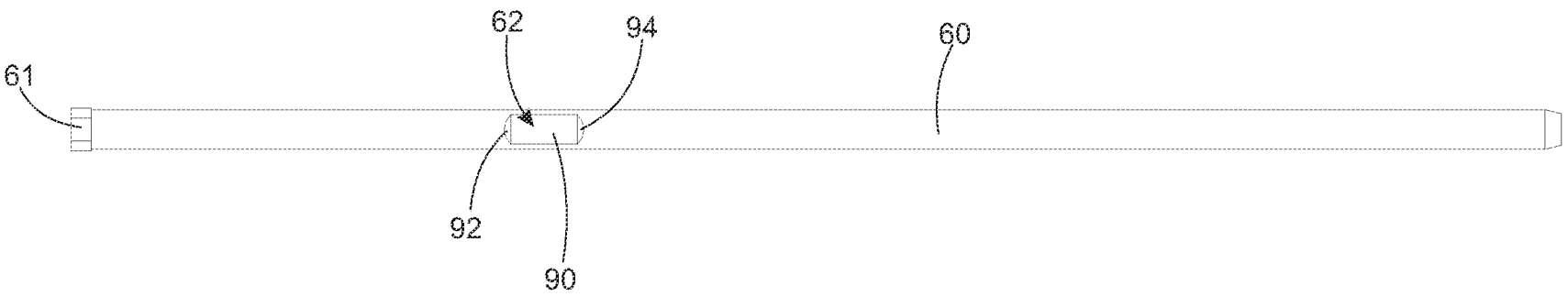
FIG. 13B is a side view of a recoil spring guide rod of a delayed blowback system according to an embodiment.
Figure 13C:
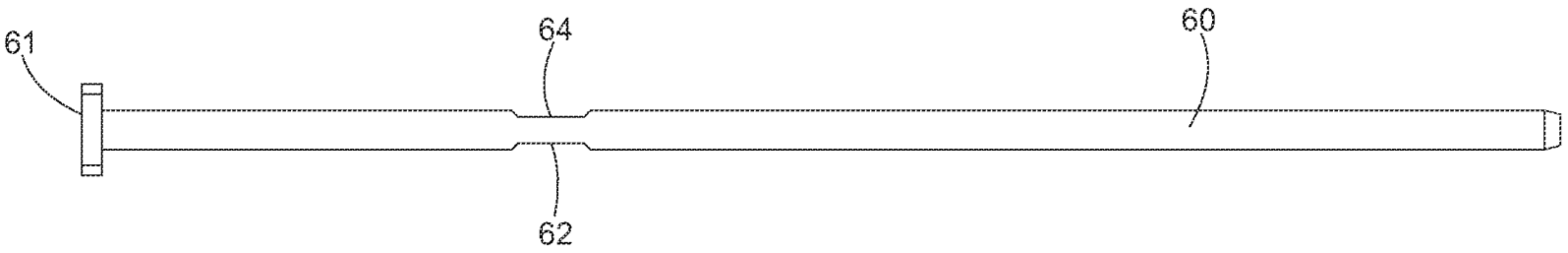
FIG. 13C is a top view of a recoil spring guide rod of a delayed blowback system according to an embodiment.
Figure 14A:
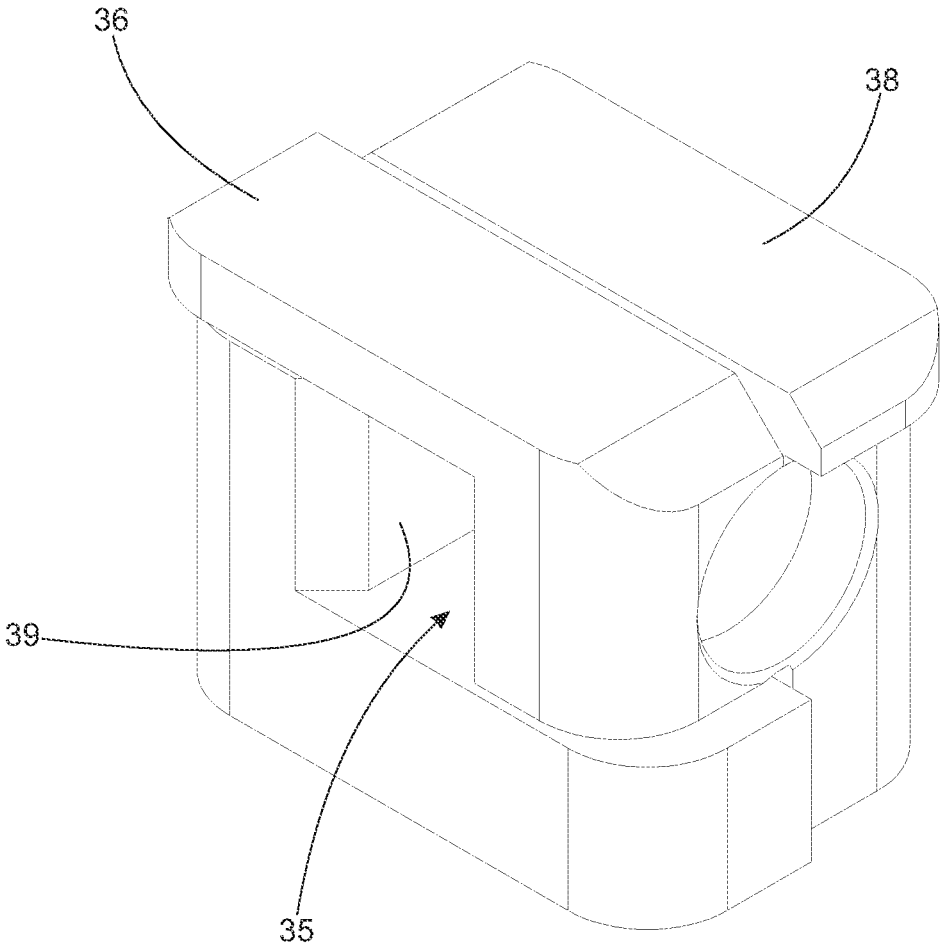
FIG. 14A is a perspective view of detent members of a delayed blowback system according to an embodiment.
Figure 14B:
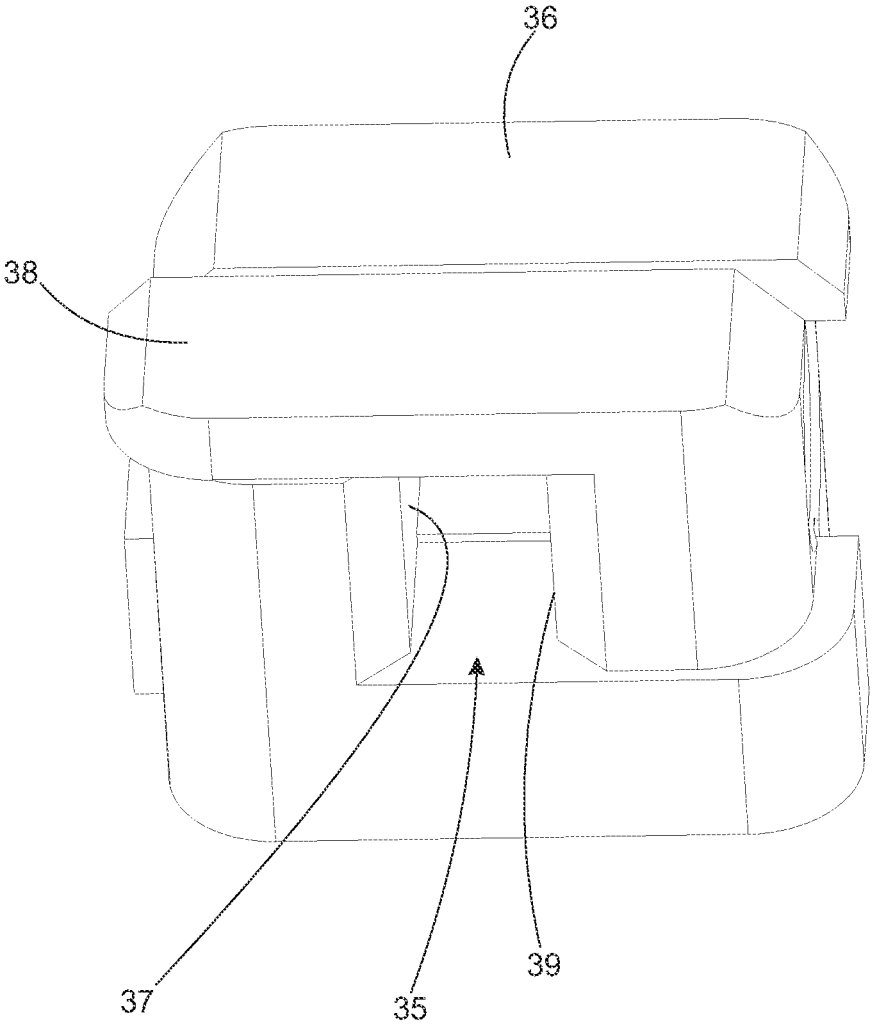
FIG. 14B is a perspective view of detent members of a delayed blowback system according to an embodiment.
Figure 14C:
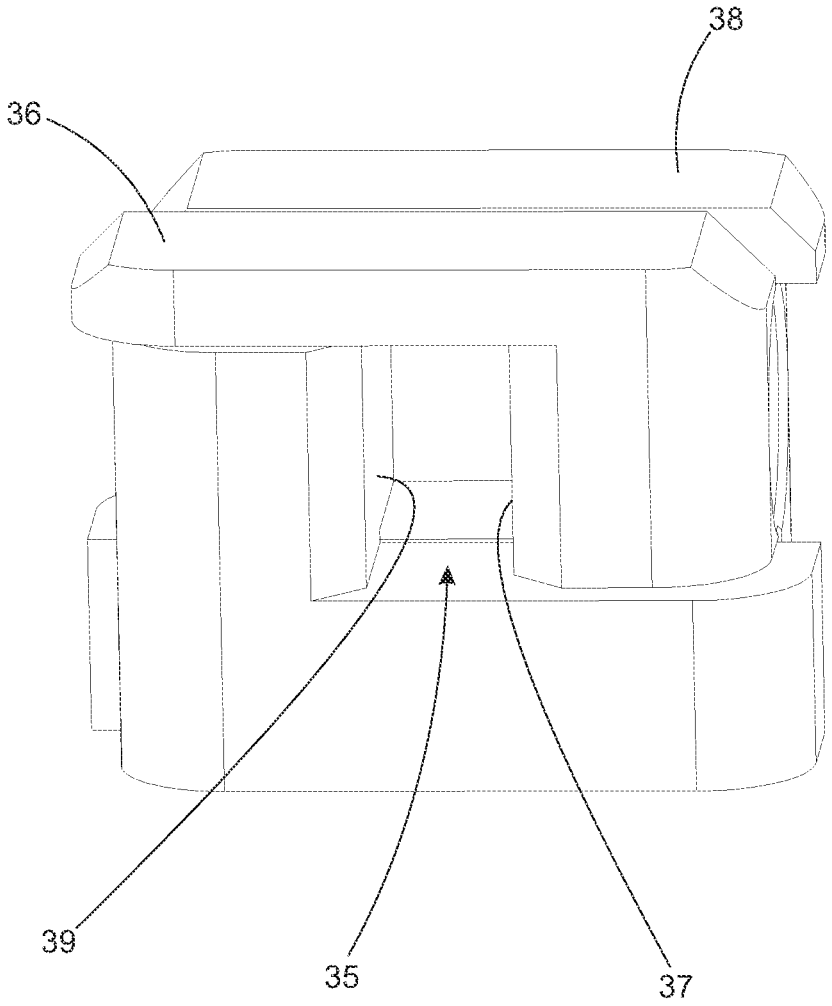
FIG. 14C is a perspective view of detent members of a delayed blowback system according to an embodiment.
Figure 14D:
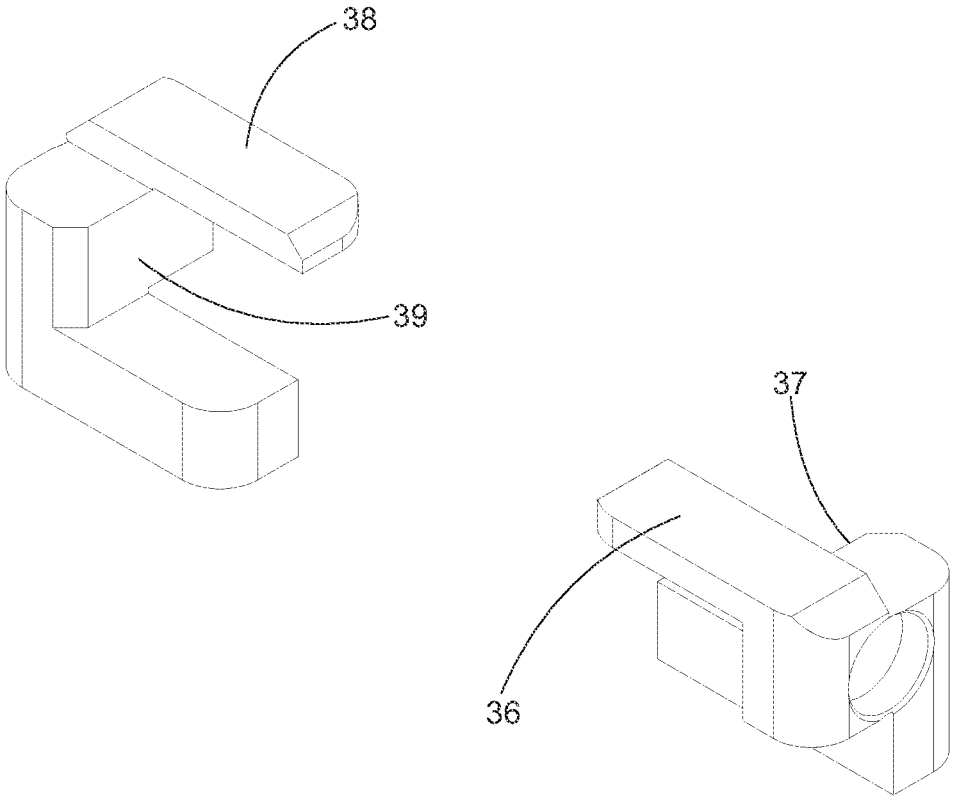
FIG. 14D is an exploded perspective view of detent members of a delayed blowback system according to an embodiment.
Figure 14E:
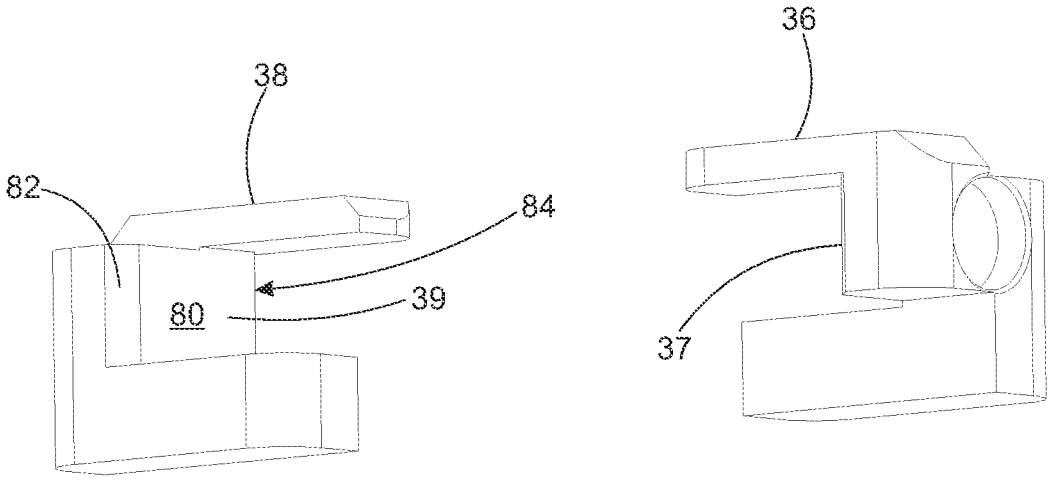
FIG. 14E is an exploded perspective view of detent members of a delayed blowback system according to an embodiment.
Figure 14F:
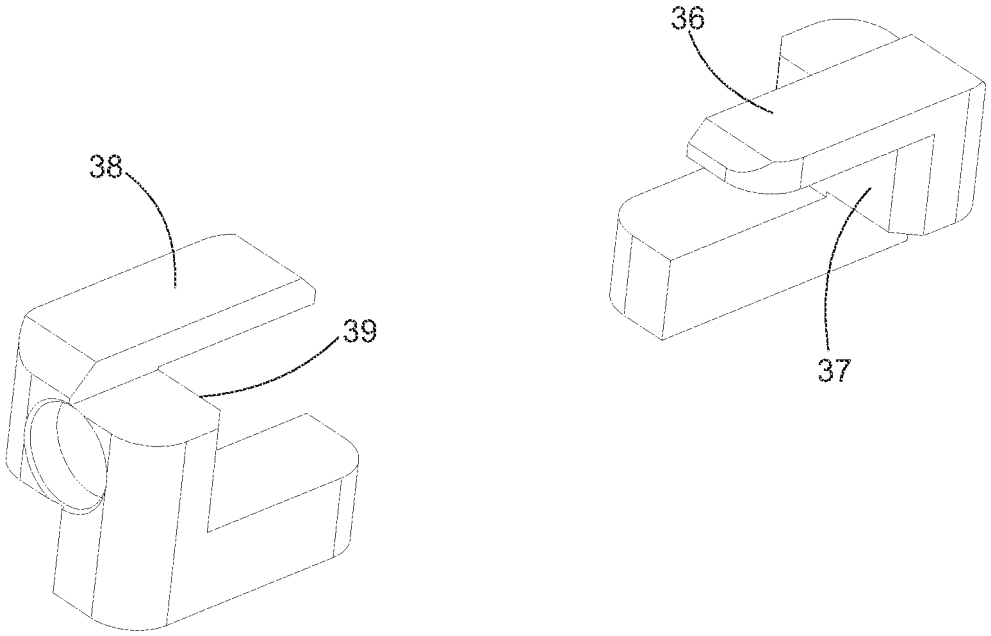
FIG. 14F is an exploded perspective view of detent members of a delayed blowback system according to an embodiment.

As shown in FIGS. 1-14F, an embodiment of a delayed blowback system 100 for a firearm 10 is depicted. For example, as depicted in FIGS. 1-8, firearm 10 may include the delayed blowback system 10 internal to the firearm 10. The firearm 10 may further include an upper receiver 12, a lower receiver 14, a handle 16, a magazine 18, a trigger 20, a trigger guard 22, a mag catch and bolt stop and ejector assembly 24, a safety lever 26, a safety plate 28, a pistol picatinny rail 30, a charging handle 32, a handguard 40 and a barrel 50.

The delayed blowback system 10 as shown in FIGS. 3-14F comprises a bolt 34 comprising a first detent member 36 and a second detent member 38, a recoil spring guide rod 60, a spring 68 and a recoil spring base 70. The first and second detent members 36, 38 are operatively coupled within the bolt 34. The first detent member 36 comprises a detent 37 and the second detent member 38 comprises a detent 39. Each detent 37 and 39 comprises a geometry that includes flat surface with two angled surfaces. The detent members 36 and 38 are virtually identical C-shaped members with an upper portion above the detents 37 and 39 and a lower member below the detents 37 and 39 and an opening on a side opposite the detents 37 and 39. In operation, the first detent member 36 is positioned with an opening in one direction and the second detent member 38 is position with an opening in the opposite direction from the opening of the first detent member 36 and the first and second detent members 36 and 38 engage with each other to form an aperture 35 defined by the upper and lower members of the first and second detent members 36 and 38 on the top and bottom and the sides of the aperture 35 defined by the detent 37 on one side and the detent 39 on an opposing side (see FIGS. 14A-14F). With the detent members 36 and 38 engaged in this configuration may be coupled within the bolt 34 with a spring coupled between each detent member 36 and 38 and the bolt 34 to bias the detent members 36 and 38 toward each other. Then the recoil spring guide rod 60 may extend through an aperture in the front of the bolt 24, through the aperture 35 formed by the detent members 36 and 38 and through an aperture in the rear portion of the bolt 34. The spring 68 is coupled over recoil spring guide rod 60 between the bolt 34 and the recoil spring base 70 that is coupled to a rear end of the recoil spring guide rod 60 that is opposite a front end comprising an engagement member 61 for engaging a barrel retainer 52 to form the delayed blowback system 100.

The recoil spring guide rod 60 comprises two matching recesses 62 and 64 on opposing sides of the recoil spring guide rod 60, wherein the matching recesses 62 and 64 have a geometry corresponding to the geometry of the detents 37 and 39. As shown in the drawing figures, the geometry of each of the detents 37 and 39 includes a flat surface 80 with two angled surfaces 82 and 84 extending from opposite sides of the flat surface 80. Additionally, as shown in the drawing figures, the geometry of each of the matching recesses 62 and 64 includes a flat surface 90 with two angled surfaces 92 and 94 extending from the flat surface 90. The bolt 34 and the two detent members 36 and 38 are coupled to and slidable along the recoil spring guide rod 60 between a firing position and a recoil position. The firing position comprises the detents 37 and 39 of the detent members 36 and 38 resting in the matching recesses 62 and 64 on the recoil spring guide rod 60 and in position for firing a round. In the firing position, the flat surfaces 80 of the detents 37 and 39 engage the flat surfaces 90 of the matching recesses 62 and 64 and the angled surfaces 82 and 84 of the detents 37 and 39 engage the angled surfaces 92 and 94 of the matching recesses 62 and 64.

The system 100 operates to create movement from the firing position to the recoil position. This comprises, in response to the round being fired, a cartridge case of the round applies an initial force on a bolt face of the bolt 34 in a direction opposite of the barrel that in turn pushes the detent members 36 and 38 back toward the recoil spring base 70, wherein by nature of a geometry of the detents 37 and 39 of the detent members 36 and 38 and the geometry of the matched recesses 62 and 64 in the recoil spring guide rod 60, the detent members 36 and 38 cannot move rearward without also moving outward in opposite directions and perpendicular from the direction of the initial force exerted by the cartridge case toward the recoil spring base 70. The movement of the detents 37 and 39 perpendicular to the direction of the initial force occurs in response to the angled surfaces of the detents 37 and 39 and the recesses 62 and 64 engaging with each other and allowing the detents 37 and 39 to slide along the angled surfaces of the recesses 62 and 64 to force the detents away and overcome the spring forces of the springs coupling the detent members 36 and 38 within the bolt. Once the detent members 36 and 38 are forced in opposite directions, the bolt 34 and the detent members 36 and 38 are in the recoil position and move along the recoil guide rod 60 in a rearward direction toward a read side of the firearm 10 performing a recoil cycle to eject the spent cartridge case and moving back to the firing position. The bolt 34 and the detent members 36 and 38 perform a cycle in response to the spring 68 compressing between the bolt 34 and the recoil spring base 70 and then expanding the spring 68 to force the bolt 34 toward the front of the firearm 10 until the first and second detent members 36 and 38 engage the matched recesses 62 and 64 in the firing position.

As stated earlier, conventional blowback designs rely on the mass of the bolt (or rather its momentum/lack of movement) being sufficient to hold the cartridge case in the chamber long enough for the bullet to exit the barrel and the pressure to be reduced so that when the cartridge case can exit the chamber without it causing a rupture of the case. This prevents injury to the operator and anyone near them.

One advantage of a delayed blowback system 100 is weight savings. The delayed blowback system 100 accomplishes the function of the simple blowback system but saves weight by mechanically amplifying the resistance of the rearward movement of the bolt 34. In this case, the momentum of the bolt 34, which is lighter than a conventional blowback system for the same firearm, is assisted by the detents 37 and 39 of the detent members 36 and 38 having to be moved outward perpendicular to the force being exerted. This adds to the resistance to the rearward movement and makes up for the lack of weight required by a simple, conventional, heavier blowback system.

The detent members 36 and 38 also perform an anti-bounce or dead blow effect when a new round is chambered as the detents 37 and 39 of the detent members 36 and 38 fall back into the respective recesses 62 and 64 under spring force.

The mag catch and bolt stop and ejector assembly 24 comprises a mag catch mount 23, a mag catch 25 and bolt stop and ejector 33. This assembly 24 has several advantages. The bolt stop and the ejector 33 is a single piece component performing both functions of an ejector and then a bolt stop when the last round of the magazine 18 is expended. The assembly 24 can be assembled or otherwise coupled together outside of the firearm 10 and then slid in and fastened or otherwise coupled to the firearm 10, making assembly of the firearm 10 easier. The magazine 18 design allows for large, rounded corners in the front that are easier to machine but requires sharp corners in the rear that are not. So, this subassembly 24 also simplifies the machining of the magazine well by filling in the back of the magazine well to give it sharp corners it requires. The subassembly 24 fills in the easier to machine large, rounded corners.

The pistol picatinny rail 30 may be a removable back piece to allow the firearm to be configured to allow for Stocks, Braces or simply cap off the end according to the regulations of the firearms configuration overall.

Other embodiments of the firearm 10 have additional advantages. For example, and without limitation, the firearm 10 operates to allow for tool-less field strip capability. Further, the system 100 and other components described herein may be utilized with firearms in different calibers and different system of actions.

Another embodiment includes a method of delaying blowback of a bolt of a firearm, the method comprising: in response to firing a round from a firearm, applying an initial force to a bolt of the firearm in a direction opposite of a barrel of the firearm, wherein detents of detent members coupled within the bolt rest within matching recesses in a recoil spring guide rod prior to firing the round; delaying recoil of the bolt along a recoil spring guide rod, wherein delaying the recoil comprises moving the detents and detent members in opposite directions and perpendicular to the direction of the initial force exerted on the bolt in response to a geometry of the detents of the detent members and a geometry of the matched recesses in the recoil spring guide rod operating to force the detents and detent members in opposite directions and perpendicular to the direction of the initial force exerted on the bolt; after delaying recoil of the bolt, moving the bolt along the recoil spring guide rod in the direction of the initial force to perform a recoil cycle; and moving back to the firing position.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A delayed blowback system for a firearm, the system comprising:

a bolt with a bolt face and two detent members operatively coupled within the bolt, each detent member comprising a detent; and a recoil spring guide rod comprising two matching recesses on opposing sides of the recoil spring guide rod, wherein the bolt and the two detent members are coupled to and slidable along the recoil spring guide rod between a firing position and a recoil position, wherein:

the firing position comprises the detents of the detent members resting in the matching recesses on the recoil spring guide rod and in position for firing a round;

movement from the firing position to the recoil position comprises, in response to the round being fired, a cartridge case of the round applies an initial force on the bolt face of the bolt in a direction opposite a barrel of the firearm, and wherein a geometry of the detents of the detent members and a geometry of the matched recesses in the recoil spring guide rod operate to force the detent members in opposite directions and perpendicular to the direction of the initial force; and moving the bolt along the recoil guide rod in the direction of the initial force to perform a recoil cycle and moving the bolt back to the firing position.

2. The system of claim 1, wherein the detent members are coupled within the bolt with a spring coupled between each detent member and the bolt to bias the detent members toward each other.

3. The system of claim 1, wherein the geometry of each detent comprises a flat surface with two angled surfaces extending from opposite sides of the flat surface.

4. The system of claim 3, wherein the geometry of each matching recess comprises a flat surface with two angled surfaces extending from opposite sides of the flat surface.

5. The system of claim 4, wherein the detents of the detent members resting in the matching recesses in the firing position comprises the flat surface of the detent and the flat surface of the matching recess and the two angled surfaces of the detents and the two angled surfaces of the matching recesses engage each other.

6. A method of delaying blowback of a bolt of a firearm, the method comprising:

in response to firing a round from a firearm, applying an initial force to a bolt of the firearm in a direction opposite of a barrel of the firearm, wherein detents of detent members coupled within the bolt rest within matching recesses in a recoil spring guide rod prior to firing the round;

delaying recoil of the bolt along a recoil spring guide rod, wherein delaying the recoil comprises moving the detents and detent members in opposite directions and perpendicular to the direction of the initial force exerted on the bolt in response to a geometry of the detents of the detent members and a geometry of the matched recesses in the recoil spring guide rod operating to force the detents and detent members in opposite directions and perpendicular to the direction of the initial force exerted on the bolt;

after delaying recoil of the bolt, moving the bolt along the recoil spring guide rod in the direction of the initial force to perform a recoil cycle; and moving back to the firing position.

* * * * *